US011622615B2

(12) United States Patent
Park et al.

(10) Patent No.: US 11,622,615 B2
(45) Date of Patent: Apr. 11, 2023

(54) BAG WITH FOLDABLE CHAIR COMPARTMENT

(71) Applicants: William Park, McLean, VA (US); Edward Park, McLean, VA (US); Richard Park, McLean, VA (US)

(72) Inventors: William Park, McLean, VA (US); Edward Park, McLean, VA (US); Richard Park, McLean, VA (US)

( * ) Notice: Subject to any disclaimer, the term of this patent is extended or adjusted under 35 U.S.C. 154(b) by 0 days.

(21) Appl. No.: 16/943,142

(22) Filed: Jul. 30, 2020

(65) Prior Publication Data

US 2021/0045514 A1 Feb. 18, 2021

Related U.S. Application Data

(60) Provisional application No. 62/886,676, filed on Aug. 14, 2019.

(51) Int. Cl.

| | |
|---|---|
| ***A45F 3/04*** | (2006.01) |
| ***A45C 3/00*** | (2006.01) |
| ***A47C 4/52*** | (2006.01) |
| ***A47C 7/02*** | (2006.01) |
| ***A63B 71/00*** | (2006.01) |
| ***A45F 4/02*** | (2006.01) |
| *A45F 3/00* | (2006.01) |

(52) U.S. Cl.

CPC ..... *A45F 3/04* (2013.01); *A45C 3/00* (2013.01); *A45F 4/02* (2013.01); *A47C 4/52* (2013.01); *A47C 7/02* (2013.01); *A63B 71/0036* (2013.01); *A45C 2003/007* (2013.01); *A45F 2003/003* (2013.01); *A63B 71/0045* (2013.01)

(58) Field of Classification Search

CPC . A45F 2004/026; A45F 2003/003; A47C 4/52

See application file for complete search history.

(56) References Cited

U.S. PATENT DOCUMENTS

| | | | | |
|---|---|---|---|---|
| RE30,138 E * | 11/1979 | Cowen, III | A45C 5/00 | 206/315.1 |
| 4,392,598 A | 7/1983 | Dixon | | |
| 4,805,748 A | 2/1989 | Gerch | | |
| 5,301,998 A * | 4/1994 | Davis | A47C 4/52 | 297/135 |
| 5,499,760 A | 3/1996 | Pielocik | | |
| 5,927,798 A * | 7/1999 | Ahn | A45C 15/00 | 297/53 |
| 5,957,349 A * | 9/1999 | Krulik | A45F 3/04 | 224/655 |
| 6,264,078 B1 | 7/2001 | Bilang | | |
| 6,997,507 B2 * | 2/2006 | Rhee | A47C 4/48 | 224/153 |
| 7,004,317 B2 * | 2/2006 | Severa | A45C 13/002 | 206/315.1 |

(Continued)

FOREIGN PATENT DOCUMENTS

| | | |
|---|---|---|
| JP | 11285407 A * | 10/1999 |
| TW | M301564 U * | 3/2006 |

*Primary Examiner* — Scott T McNurlen

(74) *Attorney, Agent, or Firm* — NSIP Law

(57) ABSTRACT

A bag includes a main compartment configured to accommodate equipment, and a foldable chair compartment disposed adjacent to the main compartment. The foldable chair compartment is configured to accommodate a foldable chair in a folded configuration.

24 Claims, 11 Drawing Sheets

(56) References Cited

U.S. PATENT DOCUMENTS

| | | | | |
|---|---|---|---|---|
| 7,628,119 | B2 * | 12/2009 | Beaty Bishop | A47C 15/004 119/474 |
| 7,644,981 | B2 * | 1/2010 | Hensley | A47C 4/52 297/53 |
| 8,820,497 | B1 | 9/2014 | Goldsmith et al. | |
| 9,642,424 | B1 * | 5/2017 | Holmes | A45C 9/00 |
| 10,070,729 | B2 | 9/2018 | Frankel et al. | |
| 2002/0113102 | A1 * | 8/2002 | Klamm | A45C 7/0077 383/4 |
| 2003/0106915 | A1 | 6/2003 | Jo | |
| 2004/0008907 | A1 | 1/2004 | Bartlett et al. | |
| 2008/0017683 | A1 * | 1/2008 | Votel | A45F 5/02 224/677 |
| 2008/0240624 | A1 * | 10/2008 | Godshaw | A45C 5/08 383/40 |
| 2010/0301078 | A1 | 12/2010 | Tamir et al. | |
| 2011/0186611 | A1 * | 8/2011 | Eberle | A45F 4/00 224/583 |
| 2013/0270875 | A1 | 10/2013 | Chamness, IV | |
| 2015/0150357 | A1 | 6/2015 | Lourenco Ferreira | |
| 2019/0159577 | A1 | 5/2019 | Tamberino | |

* cited by examiner

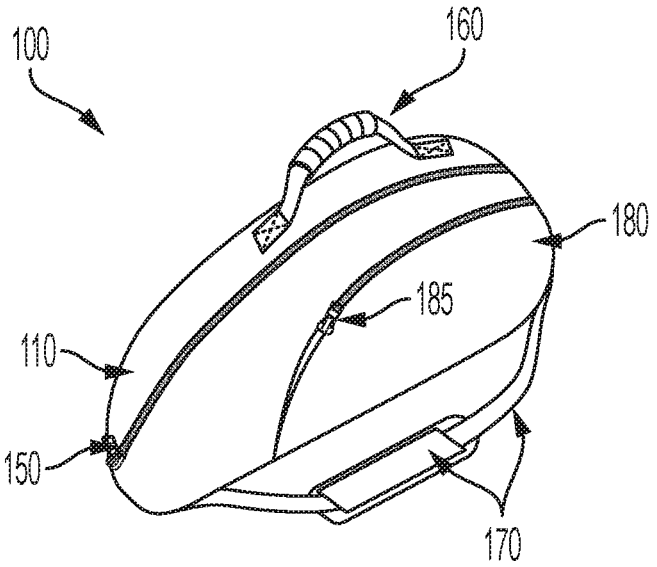
FIG. 1
CONVENTIONAL
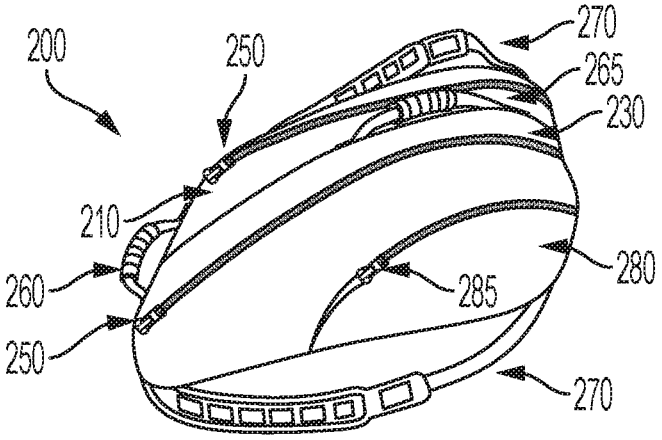
FIG. 2
CONVENTIONAL

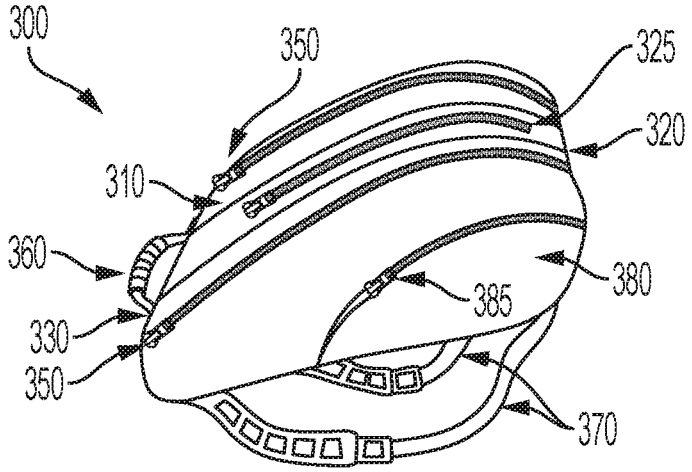
FIG. 3
CONVENTIONAL
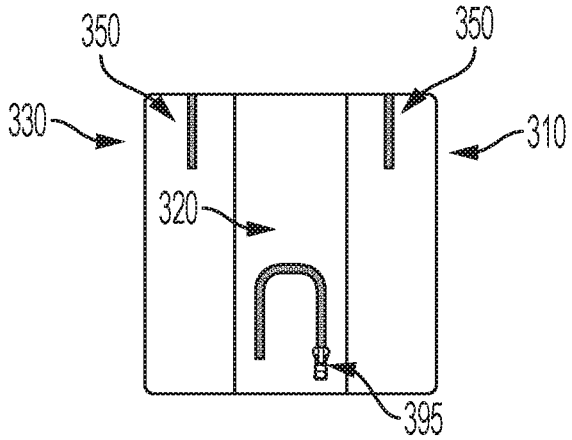
FIG. 4A
CONVENTIONAL

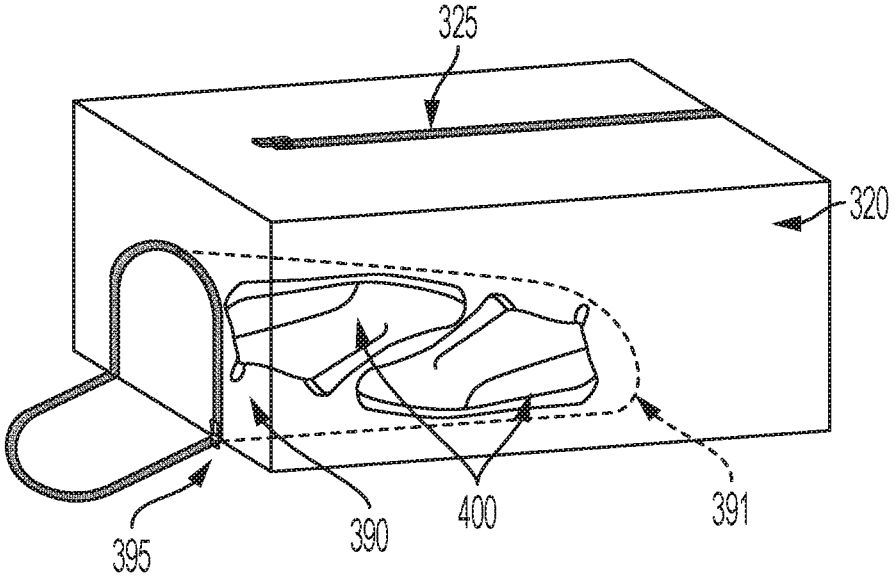
FIG. 4B
CONVENTIONAL

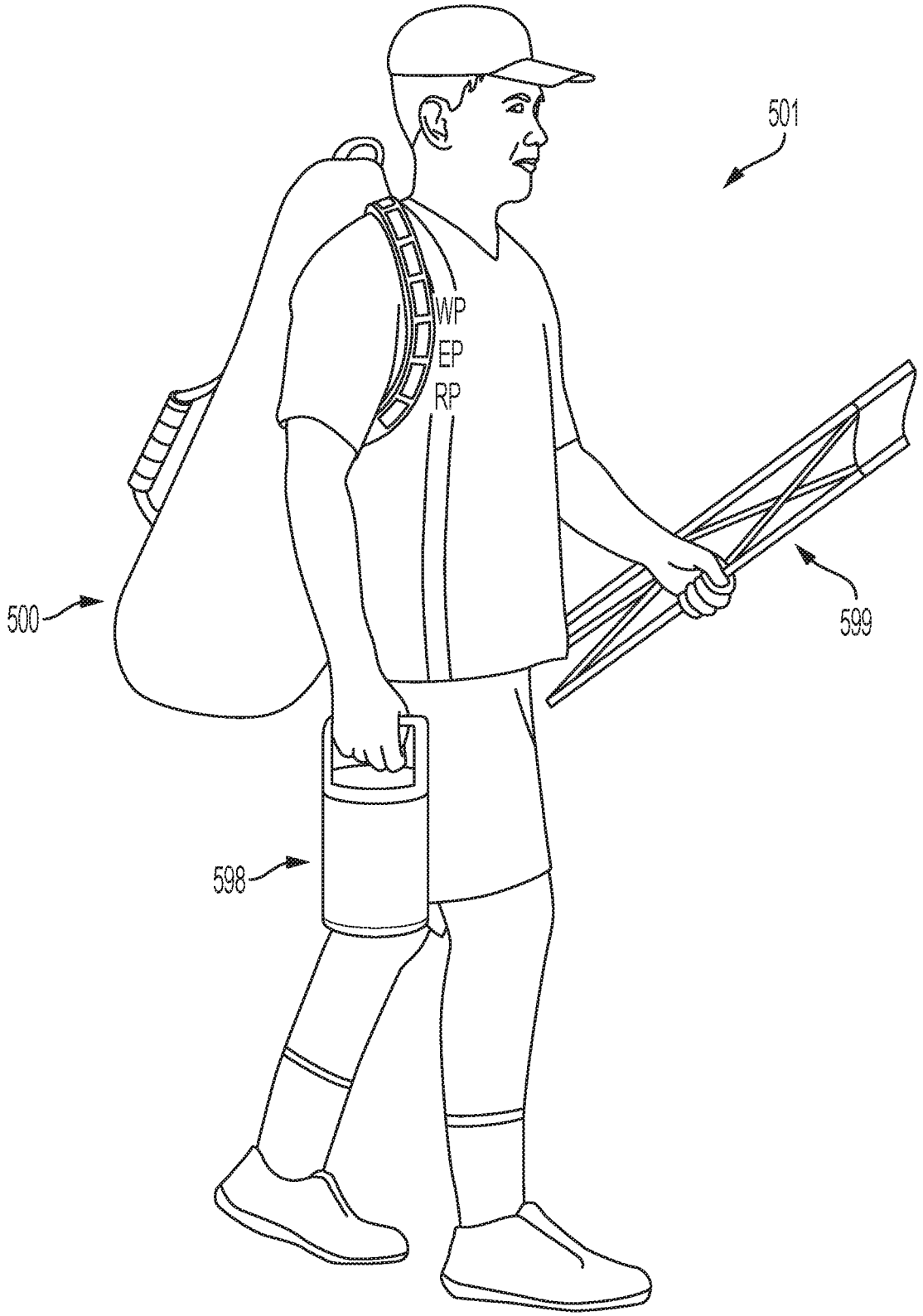
FIG. 5
CONVENTIONAL

BAG WITH FOLDABLE CHAIR COMPARTMENT

CROSS-REFERENCE TO RELATED APPLICATION

This application claims the benefit under 35 USC 119(e) of U.S. Provisional Application No. 62/886,676, filed on Aug. 14, 2019, the entire disclosures of which are incorporated herein by reference for all purposes.

BACKGROUND

1. Field

The following description relates to a bag including a foldable chair compartment.

2. Description of Related Art

Bag technologies have advanced to provide users with the convenience and performance improvements. For example, tennis bags have improved over the years to provide users with one or more main compartments to store their tennis rackets and one or more accessory compartments or pockets to store items smaller than a tennis racket, so that the users have fewer items to carry with their hands. However, recreational tennis players and tournament tennis players still experience an inconvenience when carrying items that cannot be adequately or easily stored in existing tennis bags. The same can be said about other bags, including, but not limited to, sports bags, rucksacks, and carry-on bags. Accordingly, there is a need for an improved bag that provides user convenience.

SUMMARY

This Summary is provided to introduce a selection of concepts in a simplified form that are further described below in the Detailed Description. This Summary is not intended to identify key features or essential features of the claimed subject matter, nor is this Summary intended to be used as an aid in determining the scope of the claimed subject matter.

In one general aspect, a bag includes a main compartment configured to accommodate equipment, and a foldable chair compartment disposed adjacent to the main compartment, wherein the foldable chair compartment is enclosed within side surfaces of the bag and is configured to accommodate a foldable chair in a folded configuration.

The bag may be a tennis bag, and a length of the foldable chair compartment, from a bottom of the foldable chair compartment to a top of the foldable chair compartment, may be approximately 16 inches to approximately 32 inches. A length of the bag, from a bottom of the bag to a top of the tennis bag, may be approximately 28 inches to approximately 32 inches.

The foldable chair compartment may include an open top portion or an open bottom portion.

The bag may further include a cover configured to selectively cover the open top portion of the open bottom portion.

The bag may further include a second main compartment configured to accommodate equipment. The foldable chair compartment may be disposed between the main compartment and the second main compartment.

The foldable chair compartment may be disposed in a region between an inner lateral side of the main compartment and a front side of the second main compartment.

A bottom surface of the foldable chair compartment may include holes configured to allow debris to pass through the bottom surface.

The bag may further include a protective shell configured to be inserted in the foldable chair compartment.

A bottom surface of the protective shell may include holes configured to allow debris to pass through the bottom surface, and the bottom surface of the foldable chair compartment may include holes configured to allow debris to pass through the bottom surface.

The foldable chair compartment may include the foldable chair coupled to the foldable chair compartment, and a closure member operable to selectively open and close the foldable chair compartment to place the foldable chair in an unfolded seating configuration and the folded configuration.

The main compartment may be formed of a material softer than a material of the foldable chair compartment.

The foldable chair compartment may be formed of any one of polycarbonate, acrylonitrile butadiene styrene, and polypropylene, and the main compartment may be formed of nylon or polyester.

The bag may further include shoulder straps attached to either one or both of the main compartment and the foldable chair compartment. The main compartment may be configured to accommodate at least one racket, at least one golf club, at least one baseball bat, or at least one fishing rod.

The bag may further include a second foldable chair compartment disposed adjacent to the main compartment. The second foldable chair compartment may be enclosed within the side surfaces of the bag and may be configured to accommodate an additional foldable chair in a folded configuration. The main compartment may be disposed between the foldable chair compartment and the second foldable chair compartment.

The bag may further include at least one mounting member disposed on an interior side surface of the foldable chair compartment and configured to be coupled to a stand leg of the foldable chair.

In another general aspect, a bag assembly includes a bag and a foldable chair. The bag includes a main compartment configured to accommodate equipment, a foldable chair compartment disposed adjacent to the main compartment and having an interior space enclosed within side surfaces of the bag. The foldable chair is coupled to the foldable chair compartment and configured to be stored in the interior space in a folded configuration.

The bag may further include at least one mounting member configured to be coupled to a stand leg of the foldable chair to secure the foldable chair to the bag, and the at least one mounting member may be further configured to be coupled to the stand leg such that the foldable chair is rotatable with respect to the bag.

The bag may include at least one mounting member configured to be coupled to the stand leg of the foldable chair to removably secure the foldable chair to the bag, and the at least one mounting member may include a base member attached to an inner surface of the foldable chair compartment, and a detachable member attachable to the base member to secure the stand leg between the base member and the detachable member.

The foldable chair compartment may further include a closure member operable to close the foldable chair compartment in a closed configuration and open the foldable chair compartment to an open configuration.

The bag may include the at least one mounting member configured to be coupled to the stand leg of the foldable chair to secure the foldable chair to the bag, and may be configured to be converted from a first arrangement to a second arrangement. The first arrangement may be an arrangement in which the foldable chair compartment is in the closed configuration, and the foldable chair is stored in the interior space in the folded configuration. The second arrangement may be an arrangement in which the foldable chair compartment is in the open configuration, and the foldable chair is exposed from the bag in an unfolded seating configuration.

The foldable chair may be rotatable with respect to the bag when the foldable chair compartment is in the open configuration.

The bag may include the at least one mounting member configured to be selectively coupled to the stand leg of the foldable chair to secure the foldable chair to the bag, and uncoupled from the stand leg to detach the foldable chair from the bag.

In an arrangement in which the foldable chair compartment is in an open configuration, the foldable chair may be configured to be unfolded from the folded configuration to a seating configuration.

The main compartment is configured to accommodate at least one racket, at least one golf club, at least one baseball bat, or at least one fishing rod.

A length of the main compartment, from a bottom of the main compartment to a top of the main compartment, may be approximately 28 inches to approximately 32 inches.

A length of the foldable chair may be approximately 22.8 inches to approximately 37 inches.

The main compartment may be formed of a material softer than a material of the foldable chair compartment.

The bag may further include a second main compartment configured to accommodate additional equipment. The foldable chair compartment may be disposed between the main compartment and the second main compartment, or the main compartment may be disposed between the foldable chair compartment and the second main compartment.

The bag may further include a second foldable chair compartment disposed adjacent to the main compartment and having a second interior space enclosed within the side surfaces of the bag. The second interior space may be configured to store an additional foldable chair in a folded configuration. The main compartment may be disposed between the foldable chair compartment and the second foldable chair compartment.

In another general aspect, a bag assembly includes at least one main compartment configured to accommodate equipment, a foldable chair compartment, a foldable chair coupled to the foldable chair compartment, and a closure member operable to selectively open and close the foldable chair compartment to place the foldable chair in an unfolded seating configuration and a folded configuration.

The bag assembly may further include at least one mounting member configured to couple the foldable chair to the foldable chair compartment such that the foldable chair is rotatable with respect to the bag assembly.

The bag assembly may be a tennis bag and the at least one main compartment may be configured to store at least one tennis racket.

The at least one main compartment may be configured to accommodate at least one racket, at least one golf club, at least one baseball bat, or at least one fishing rod.

The foldable chair may be removably coupled to the foldable chair compartment.

The foldable chair may be configured to be stored substantially within an interior space of the foldable chair compartment in the folded configuration.

The bag assembly may further include a second foldable chair compartment configured to accommodate a second foldable chair in a folded configuration.

bag assembly may further include the second foldable chair coupled to the second foldable chair compartment, and a second closure member operable to selectively open and close the second foldable chair compartment to place the second foldable chair in an unfolded seating configuration and the folded configuration.

Other features and aspects will be apparent from the following detailed description, the drawings, and the claims.

BRIEF DESCRIPTION OF THE DRAWINGS

FIG. 1 is a diagram illustrating a conventional tennis bag including a main compartment.

FIG. 2 is a diagram illustrating a conventional tennis bag including two main compartments.

FIG. 3 is a diagram illustrating an example of a conventional tennis bag including two main compartments and a center accessory compartment.

FIGS. 4A and 4B are diagrams illustrating a shoe pocket of the center accessory compartment of the tennis bag of FIG. 3.

FIG. 5 is a diagram illustrating a user carrying a conventional tennis bag while also carrying other items.

Figure 6A:
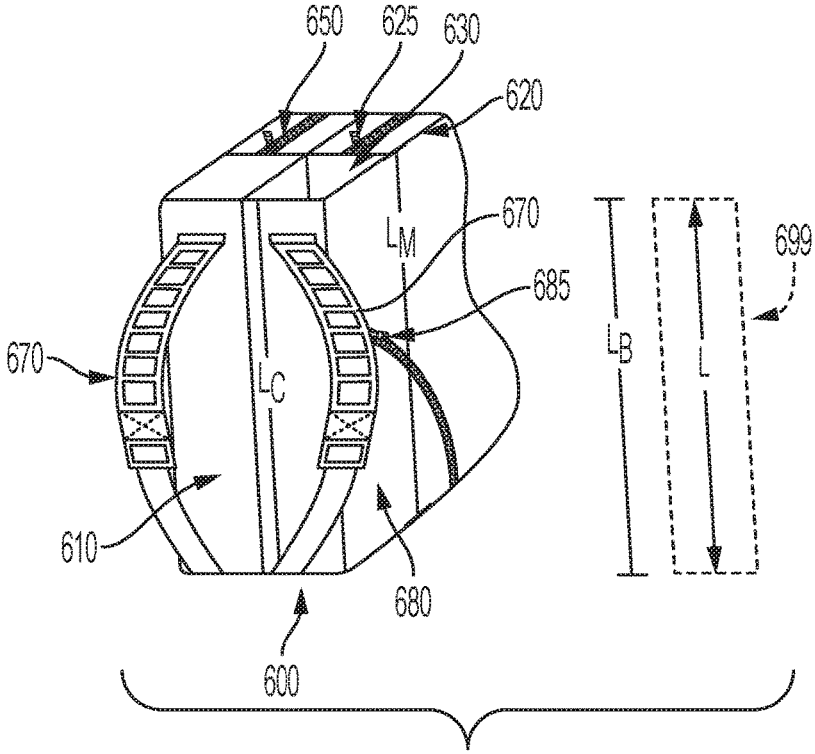
FIGS. 6A and 6B are diagrams illustrating a bag including a foldable chair compartment, according to an embodiment.

Throughout the drawings and the detailed description, the same drawing reference numerals refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. Also, descriptions of features that are known in the art or previously disclosed may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Terms such as first, second, A, B, (a), (b), and the like may be used herein to describe components. Each of these terminologies is not used to define an essence, order, or sequence of a corresponding component but used merely to distinguish the corresponding component from other component(s). For example, a first component may be referred to as a second component, and similarly the second component may also be referred to as the first component.

It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, operations, elements, and/or components in an example embodiment, but do not preclude the presence or addition of one or more other features, integers, operations, elements, components, and/or groups thereof in alternative embodiments, nor the lack of such stated features, integers, operations, elements, components, and/or combinations/groups thereof in further alternative embodiments unless the context and understanding of the present disclosure indicates otherwise. The use of the term 'may' herein with respect to an example or embodiment, e.g., as to what an example or embodiment may include or implement, means that at least one example or embodiment exists where such a feature is included or implemented while all examples and embodiments are not limited thereto.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a diagram illustrating a conventional tennis bag 100, including a main compartment 110. Referring to FIG. 1, tennis bag 100 includes the main compartment 110 sized and configured to store one or more tennis rackets, a zipper 150 operable to provide access the main compartment 110, a grab-handle 160, a shoulder strap 170, an accessory compartment 180 sized and configured to store items smaller than a tennis racket, and a zipper 185 operable to provided access the accessory compartment 180.

FIG. 2 is a diagram illustrating a conventional tennis bag 200 including two main compartments (a first main compartment 210 and a second main compartment 230). Referring to FIG. 2, the first main compartment 210 is sized and configured to store one or more tennis rackets and the second main compartment 230 sized and configured to store one or more tennis rackets. The bag 200 further includes zippers 250 operable to provide access to the first main compartment 210 and the second main compartment 230, respectively, grab-handles 260 and 265, shoulder straps 270, an accessory compartment 280 sized and configured to store items smaller than a tennis racket, and a zipper 285 operable to provide access to the accessory compartment 280.

FIG. 3 is a diagram illustrating a conventional tennis bag 300 including two main compartments (a first main compartment 310 and a second main compartment 330), and a center accessory compartment 320. Referring to FIG. 3, the first main compartment 310 is sized and configured to store one or more tennis rackets and the second main compartment 330 is sized and configured to store one or more tennis rackets. The bag 300 further includes zippers 350 operable to provide access to the first main compartment 310 and the second main compartment 330, respectively, a grab-handle 360, shoulder straps 370, a center accessory compartment 320 to sized and configured to store items typically smaller than a tennis racket, a zipper 325 operable to provide access to the center accessory compartment 320, an accessory compartment 380 sized and configured to store items smaller than a tennis racket, and a zipper 385 configured to provide access the accessory compartment 380. Although the center accessory compartment 320 is provided, in general, to store items smaller than a tennis racket, for example, shirts, shorts, towels, and so on, in some cases the center accessory compartment 320 may be sized and configured to function as another main compartment to store an additional tennis racket.

FIGS. 4A and 4B are diagrams illustrating a shoe pocket 390 of the center accessory compartment 320 of the tennis bag 300 of FIG. 3. Referring to FIGS. 4A and 4B, in this example, the tennis bag 300 further includes the shoe pocket 390, and a zipper 395 operable to provide access the shoe pocket 390. As an example, a pair shoes 400 may be stored in the shoe pocket 390. The shoe pocket 390 is provided within the center accessory compartment 320, and includes a pocket liner 391 disposed along and defining an outer boundary of the shoe pocket 390. When the tennis bag 300 includes the shoe pocket 390, and especially when carrying the shoes 400, the center accessory compartment 320 may not have the storage capacity to store a tennis racket due to the shoes 400 filling the volume within the center accessory compartment 320. Referring back to FIG. 4B, the shoe pocket 390 is sized and configured to accommodate the shoes 400 with easy access. That is, although the shoes 400 may not be shown to scale to illustrate the use of the shoe pocket 390, the length of the shoe pocket 390 is such that a user can easily retrieve the shoes 400 without the need to dig into the shoe pocket 390 with the user's hand.

FIG. 5 is a diagram illustrating a user 501 carrying a conventional tennis bag 500, for example, similar to the tennis bag 200 of FIG. 2, while also carrying other items. The other items may include, for example, a water jug 598 and a foldable chair 599. For recreational and tournament tennis players, such players may not always find a bench in the tennis court. This leads to inconvenience because, during time between games of a match, the tennis player has to stand or sit on the ground in a less comfortable position than a position sitting on a bench. Alternatively, the tennis player may also bring the foldable chair 599 to the court. However, transporting the foldable chair 599 may be cumbersome and carrying the foldable chair 599 to the court may be inconvenient. For example, in an all-day tournament held outside during warm weather, players may bring the tennis bag 500 with several rackets inside, with the tennis bag 500 also holding the water jug 598 and often holding a can of tennis balls, such as a can of tennis balls distributed by a tournament coordinator before the match. In this case, it is inconvenient for the players to bring the foldable chair 599 to the court.

Figure 6B:
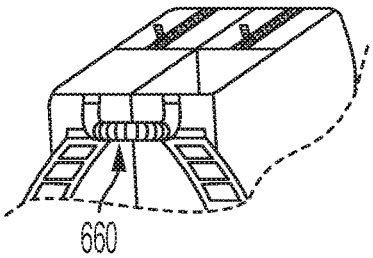

FIGS. 6A and 6B are diagrams illustrating a bag 600 including a foldable chair compartment 630, according to an embodiment. Referring to FIG. 6A, the bag 600 includes, for example, a main compartment 610 and a foldable chair compartment 630. The bag 600 may further include a zipper 650 operable to provide access to (e.g. open and close) the main compartment 610, an accessory compartment 680, a zipper 685 operable to provide access to the accessory compartment 680, a grab-handle 660, and shoulder straps 670. The bag 600 may further include a second or secondary main compartment 620 and a zipper 625 operable to provide access to the secondary main compartment 620. The foldable chair compartment 630 may be disposed along an entire length $L_B$ of the bag 600, or along substantially the entire length $L_B$, to receive a foldable chair 699 (illustrated in its folded position by the broken lines). The length $L_B$ of the bag 600 is an overall or maximum length of the bag 600, and may be the same as or substantially the same as a length $L_M$ of the secondary main compartment 620. For example, the foldable chair compartment 630 may be disposed generally in one quadrant of the bag 600, adjacent to an inner lateral side of the main compartment 610 and a front side of the secondary main compartment 620. That is, the foldable chair compartment 630 may be disposed in a front corner region of the bag 600, in a region between the inner lateral side of the main compartment 610 and the front side of the secondary main compartment 620. The foldable chair 699 may also be referred to as a folding chair. As can be seen in FIG. 6A, the foldable chair 699 may be quickly stored in or retrieved from the foldable chair compartment 630.

The accessory compartment 680 may be disposed on an outer side surface of the main compartment 610 and/or the foldable chair compartment 630. While the accessory compartment 680 is described or shown on the outside of the bag 600, it is understood that the accessory compartment 680 may be provided, alternatively or additionally, on the inside of the bag 600.

Foldable chairs or folding chairs are well known in the art and may be formed to have different lengths L (e.g., when folded) and components (e.g., with or without armrests). Depending on the length L of the foldable chair 699 and the length $L_B$ of the bag 600, the foldable chair 699, when inserted into the foldable chair compartment 630, may have one end disposed substantially flush with an end of the bag 600 in the direction of the length $L_B$ of the bag 600, may be recessed slightly inside the foldable chair compartment 630, or may be received in the foldable chair compartment 630 such that a portion of the foldable chair 699 protrudes outwardly from the bag 600. For example, the length L of the foldable chair 699 may be from 22.8 inches to 37 inches. For example, the length $L_B$ of the bag 600 may be from 28 inches to 32 inches. Accordingly, for example, the foldable chair compartment 630 may be formed along the length $L_B$ of the bag 600 and configured to receive the foldable chair 699 such that, when the foldable chair 699 is in a folded configuration, a majority or an entirety of the foldable chair 699 is secured in an interior space of the foldable chair compartment 630. For example, a length $L_C$ of the foldable chair compartment 630 may vary depending on a type of the bag 600 (e.g., a tennis bag, a sports bag, a carry-on bag, etc.). For example, the length $L_C$ of the foldable chair compartment 630 may be from 16 inches to 32 inches. According to an embodiment, the length $L_C$ of the foldable chair compartment 630 may be from 28 inches to 32 inches. The length of the interior space of the foldable chair compartment may be substantially the same as the length $L_C$, which may be an overall length of the foldable chair compartment 630. According to an embodiment, the bag 600 may be a tennis bag, and the main compartment 610 and the secondary main compartment 620 may each be sized and configured to store one or more tennis rackets in their respective interior spaces. In an example, the length $L_B$ of the bag 600 may be from 28 inches to 32 inches and the foldable chair compartment 630 may be disposed along the length $L_B$ of the bag 600, and may include an opening sized and configured to receive the foldable chair 699.

Figure 7:
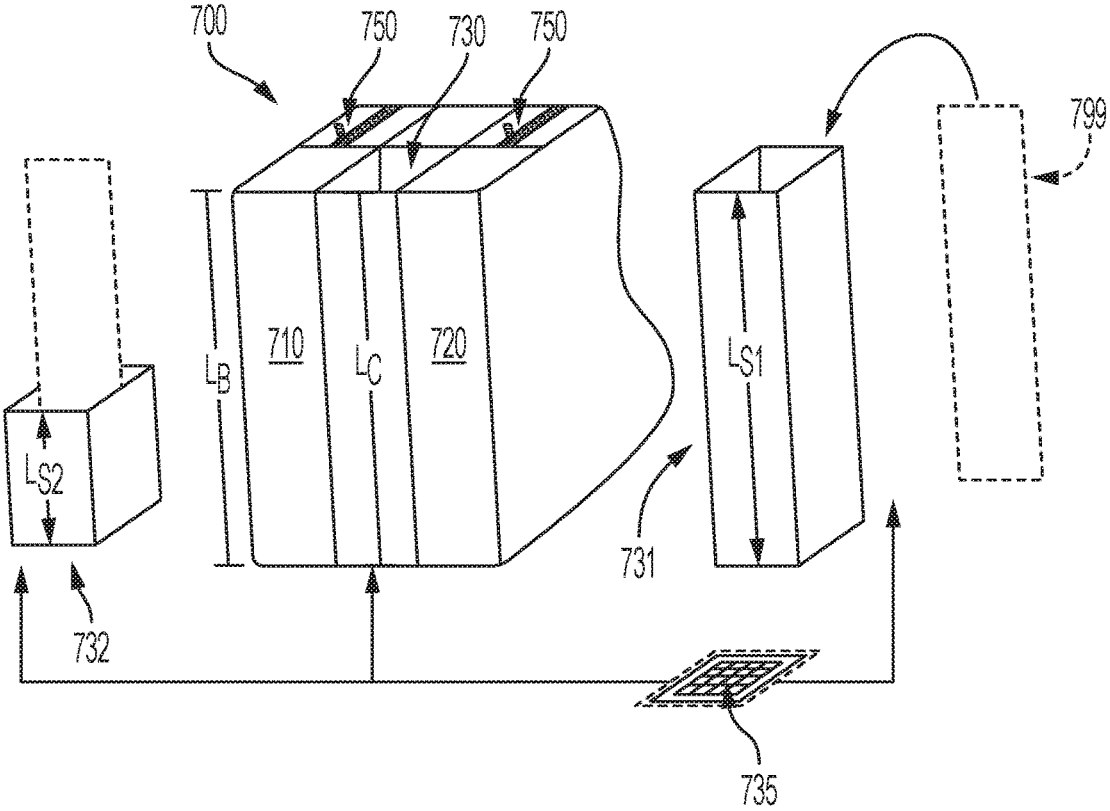
FIG. 7 is a diagram illustrating a bag including a foldable chair compartment, according to another embodiment.

FIG. 7 is a diagram illustrating a bag 700 including a foldable chair compartment 730, according to another embodiment. Referring to FIG. 7, the bag 700 may include, for example, a first main compartment 710 and a second main compartment 720. The foldable chair compartment 730 may be disposed between the first and second main compartments 710 and 720. For example, the foldable chair compartment 730 may be generally disposed at a front portion of the bag 700, between inner lateral sides of the first and second main compartments 710 and 720. The bag 700 may further include zippers 750 operable to provide access to the first and second main compartments 710 and 720, respectively. Although not shown, the bag 700 may further include one or more accessory compartments, one or more grab-handles, one or more shoulder straps, and additional zippers operable to provide access to the various compartments. The foldable chair compartment 730 may comprise an interior liner formed of a material similar to a material of the exterior of the bag 700, for example, any one of known exterior materials of a tennis bag, to improve durability for many repetitions of storing and retrieving a foldable chair 799. The bag 700 may include, instead of or in addition to the liner, a first shell 731 or a second shell 732 disposed in the foldable chair compartment 730 to protect the foldable chair compartment 730 and the bag 700. In an example, the first shell 731 and the second shell 732 may be removable from the foldable chair compartment 730. A length of the shell 731 may correspond to the length $L_C$ of the foldable chair compartment 730. Since the majority of contact between the foldable chair 799 and the bag 700, when inserting the foldable chair 799 into the bag 700 or retrieving the foldable chair 799 from the bag 700, may occur between a foot (e.g., bottom end) of the foldable chair 799 and the bottom of the foldable chair compartment 730 in the direction of the length $L_C$ of the foldable chair compartment 730, a length $L_{S2}$ of the shell 732 may be less than the length '$L_{S1}$' of the shell 731. Further, the bottom of the foldable chair compartment 730, the shell 731, and/or the shell 732 (in the direction of the lengths $L_C$, $L_{S1}$, and/or $L_{S2}$) may include one or more holes 735 configured to facilitate removal of gathered debris by allowing debris to pass through the holes 735. Alternatively, the bottom of the foldable chair compartment 730, the shell 731, and/or the shell 732 may instead be solid (without the one or more holes 735) in other embodiments. Additionally, the shapes of the openings of the foldable chair compartment 730, the shell 731, and the shell 732 may include shapes other than the shapes shown. For example, the shapes may be round or oval, rather than rectangular, in other embodiments. According to an embodiment, the bag 700 may be a tennis bag, and the first and second main compartments 710 and 720 may each be sized and configured to store one or more tennis rackets.

Figure 8A:
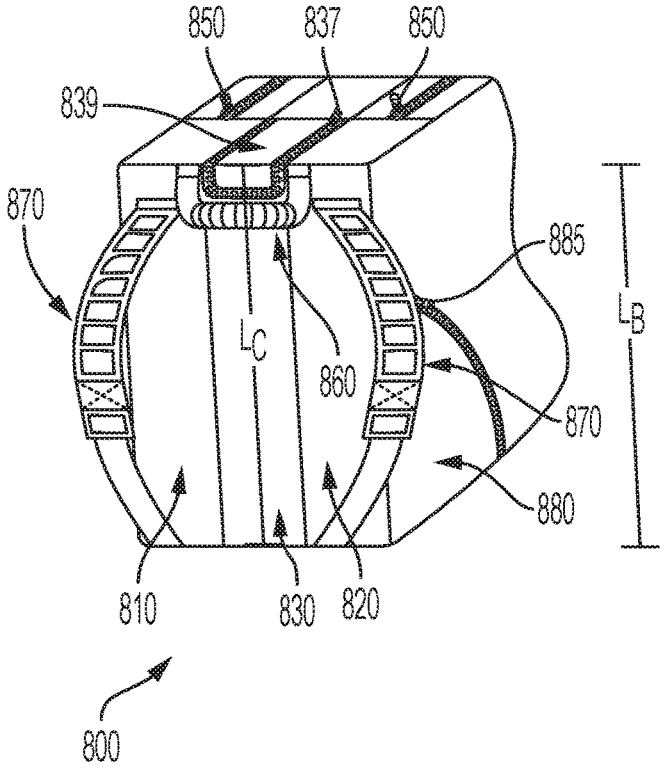
FIGS. 8A and 8B are diagrams illustrating a bag including a foldable chair compartment, according to another embodiment.
Figure 8B:
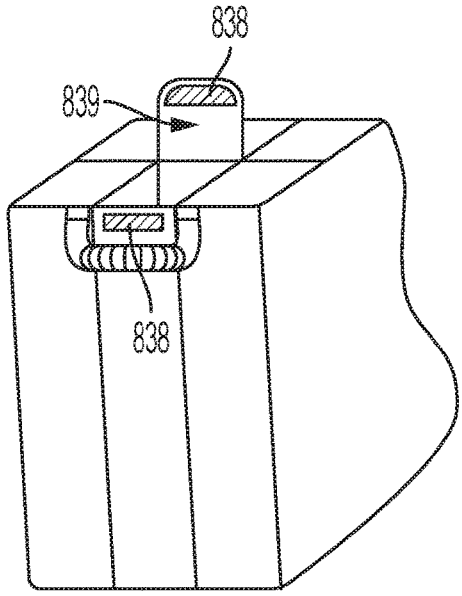

FIGS. 8A and 8B are diagrams illustrating an example of a bag 800 including a foldable chair compartment 830, according to another embodiment. Referring to FIG. 8A, the bag 800 may include, for example, a first main compartment 810, a second main compartment 820, the foldable chair compartment 830, and a cover 839 of the foldable chair compartment 830. The bag 800 may further include a grab-handle 860, shoulder straps 870, zippers 850 operable to provide access to the first and second main compartments 810 and 820, an accessory compartment 880, and a zipper 885 operable to provide access to the accessory compartment 880. The accessory compartment 880 may be disposed on an outer side surface of the second main compartment 820. Alternatively, the accessory compartment 880 may be disposed on an outer side surface of the first main compartment 810, or two accessory compartments 880 may be respectively disposed on outer side surfaces of the first main compartment 810 and the second main compartment 820.

The bag 800 may include the cover 839 configured to selectively cover a top opening of the foldable chair compartment 830, and may further include a zipper 837 operable to provide access to the foldable chair compartment 830. Referring to FIG. 8B, the cover 839 may include a hook-and-loop (e.g., velcro) fastening member 838 instead of the zipper 837. According to an embodiment, the cover 839 may be elastic and/or the length of the cover 839 may be extendable such that the cover 839 is configured to wrap over a foldable chair (not shown) inserted in the foldable chair compartment 830, in a case in which the length $L_B$ of the bag 800, and thus the length $L_C$ of the foldable chair compartment 830, is shorter than the length of the foldable chair. According to an embodiment, the bag 800 may be a tennis bag and the first and second main compartments 810 and 820 may be sized and configured to store one or more tennis rackets.

Figure 9:
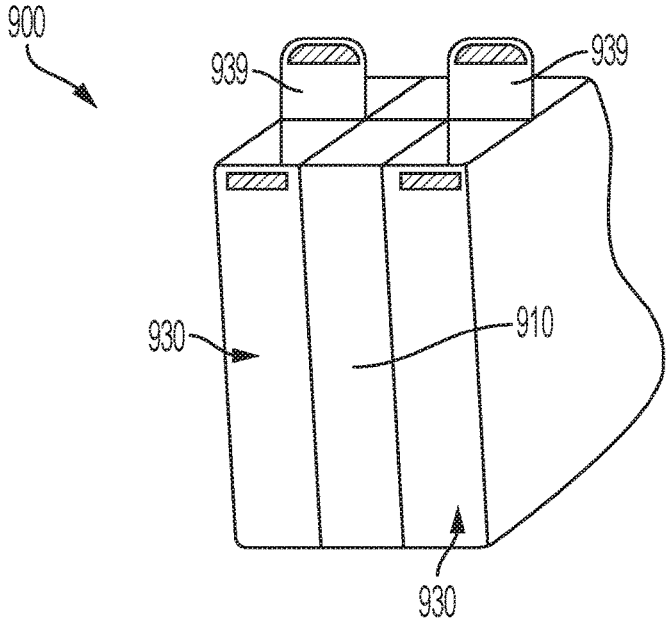
FIG. 9 is a diagram illustrating a bag including a foldable chair compartment, according to another embodiment.

FIG. 9 is a diagram illustrating an example of a bag 900 including a foldable chair compartment 930, according to another embodiment. Referring to FIG. 9, the bag 900 may include, for example, two foldable chair compartments 930 and covers 939. Although not shown, the bag 900 may further include one or more accessory compartments, one or more grab-handles, one or more shoulder straps, and zippers operable to provide access to the various compartments. According to an embodiment, the bag 900 may be a tennis bag and may further include a main compartment 910 disposed between the foldable chair compartments 930. The main compartment 910 may be sized and configured to store one or more tennis rackets. For example, the foldable chair compartments 930 may be respectively disposed at side regions of the bag 900 with respect to a lateral/width direction of the bag, and the main compartment 910 may be disposed at a central region of the bag 900 with respect to the width direction. It is to be understood that further description is not provided for brevity and conciseness.

Figure 10:
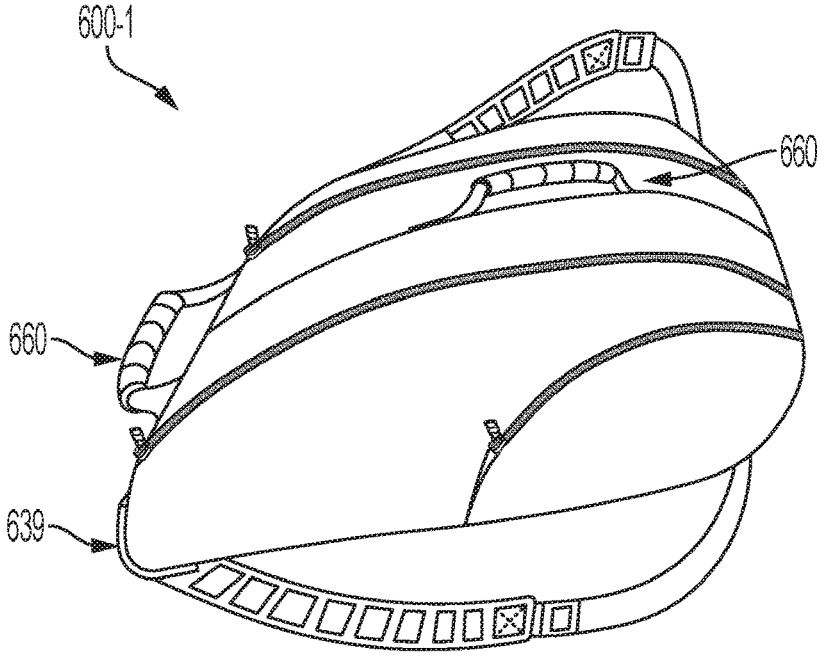
FIG. 10 is a diagram illustrating a bag including a cover for a foldable chair compartment, according to another embodiment.

FIG. 10 is a diagram illustrating a bag 600-1, according to another embodiment. Referring to FIG. 10, the bag 600-1 is similar to the bag 600 of FIGS. 6A and 6B, but further includes a cover 639 configured to cover the foldable chair compartment 630. Additionally, the bag 600-1 may further include an additional grab-handle. For example, the bag 600-1 may include two grab-handles 660.

Figure 11:
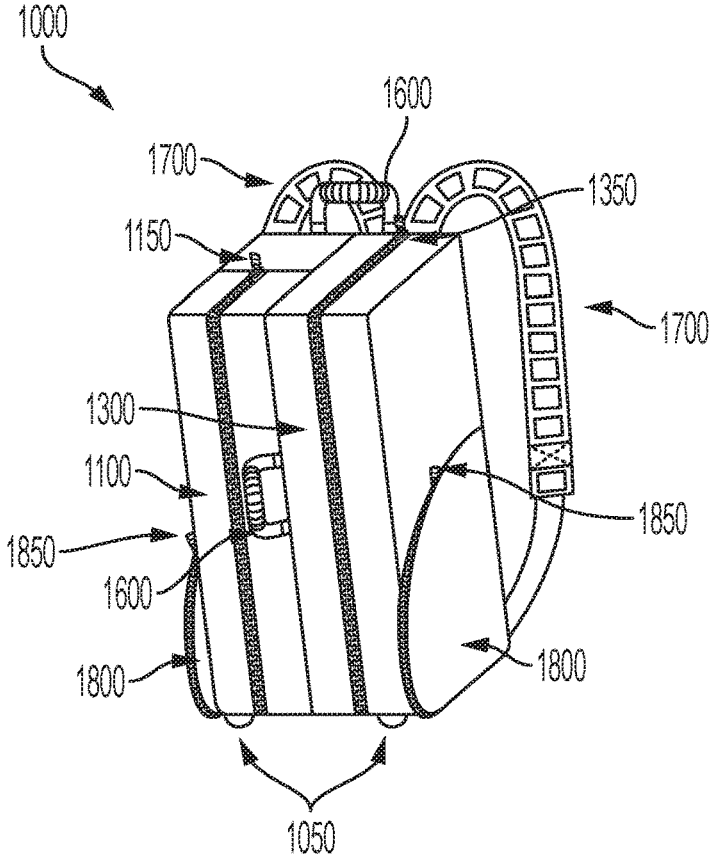
FIGS. 11, 12 and 13 are diagrams illustrating a bag including a foldable chair compartment, according to another embodiment.
Figure 12:
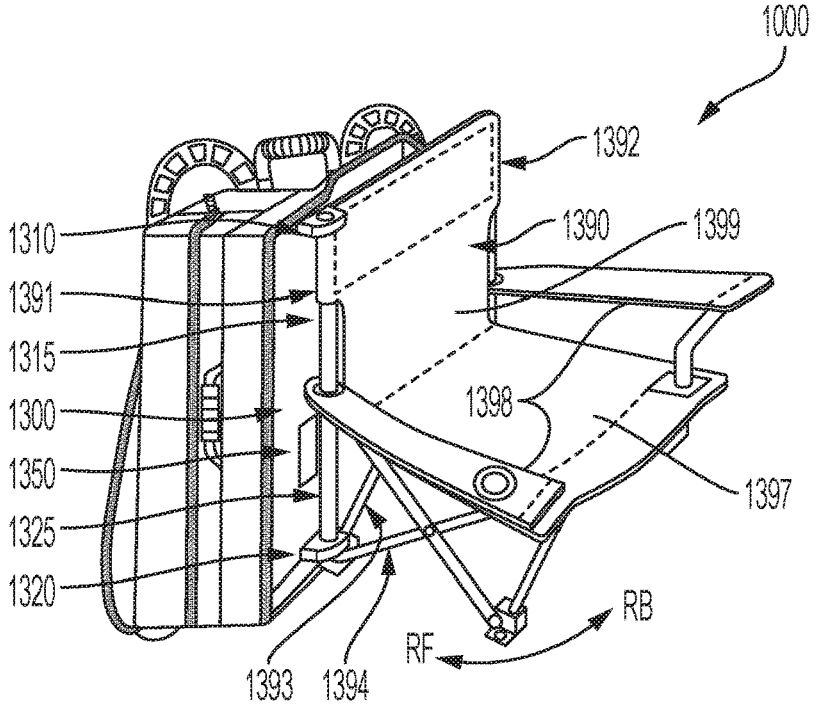
Figure 13:
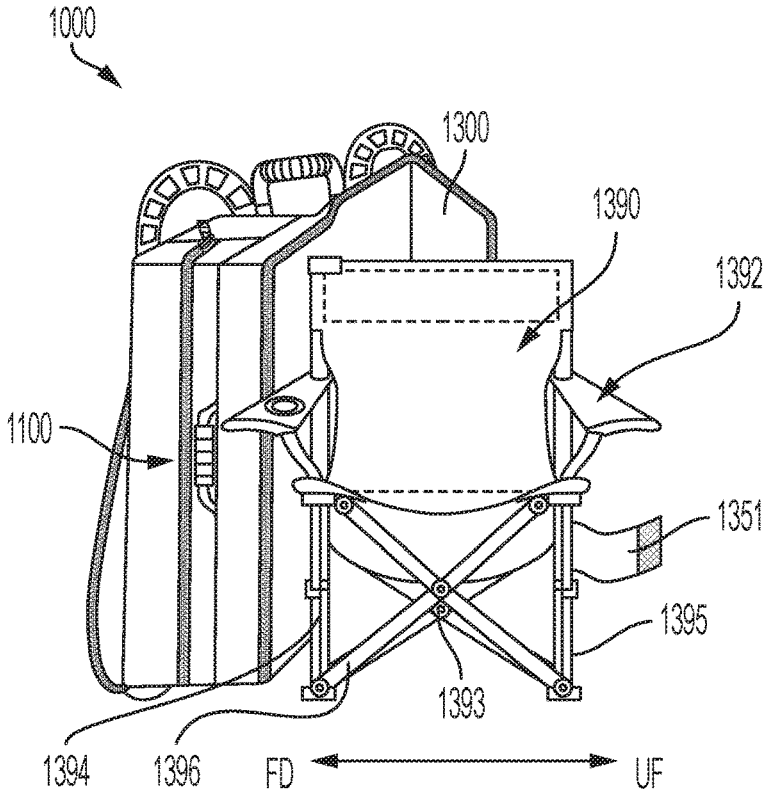

FIGS. 11, 12 and 13 are diagrams illustrating an example of a bag 1000 including a foldable chair compartment 1300, according to another embodiment. Referring to FIGS. 11, 12, and 13, the bag 1000 may include, for example, a main compartment 1100, a foldable chair compartment 1300, and a foldable chair 1390. The bag 1000 may further include grab-handles 1600, shoulder straps 1700, accessory compartments 1800, zippers 1850 operable to provide access to the accessory compartments 1800, a zipper 1150 operable to provide access to the main compartment 1100, a zipper 1350 operable to provide access to the foldable chair compartment 1300, and bag legs 1050 configured to support the bag 1000 in an upright position. The bag 1000 may include a greater or fewer number of accessory compartments 1800 and corresponding zippers 1850 than the number of accessory compartments 1800 and corresponding zippers 1850 shown in FIG. 11.

For example, the main compartment 1100 and the foldable chair compartment 1300 may be disposed adjacent to each other (e.g., side-by-side) in a width direction of the bag 1000. The accessory compartments 1800 may be disposed on outer sides of the main compartment 1100 and the foldable chair compartment 1300, respectively.

FIG. 11 shows the bag 1000 with the foldable chair compartment 1300 in a closed position. FIGS. 12 and 13 show the bag 1000 with the foldable chair compartment 1300 in an open position in which the foldable chair 1390 swings out and unfolds to allow a user (not shown) to sit. According to an embodiment, the bag 1000 may be a tennis bag and the main compartment 1100 may be sized and configured to store one or more tennis rackets. As can be appreciated, the foldable chair 1390 may be quickly stored in or retrieved from the bag 1000 through being housed by the foldable chair compartment 1300.

Referring to FIG. 12, according to an embodiment, the foldable chair 1390 may include a first rear stand leg 1391 and a second rear stand leg 1392. The foldable chair compartment 1300 may include a first pin member 1310 disposed, for example, on an inner side surface of the foldable chair compartment 1300 in an upper area 1315 of the foldable chair compartment 1300, and a second pin member 1320 disposed, for example, on the inner side surface of the foldable chair compartment 1300 in a lower area 1325 of the foldable chair compartment 1300. The foldable chair 1390 may include, for example, a total of 10 stand legs, including the first rear stand leg 1391, the second rear stand leg 1392, third rear stand legs 1393, first side stand legs 1394, second side stand legs 1395, and front stand legs 1396.

The first rear stand leg 1391 of the foldable chair 1390 may have ends rotatably coupled to the first pin member 1310 and the second pin member 1320 of the foldable chair compartment 1300 such that the first rear stand leg 1391 rotates with respect to the foldable chair compartment 1300. In this example, the foldable chair 1390 may rotate back (RB) and forth (RF) with respect to the foldable chair compartment 1300.

The first and second rear stand legs 1391 and 1392 may extend in the direction of the length $L_B$ of the bag 1000. The third rear stand legs 1393 may be pivotally connected to each other at a center pivot point, and may each have first ends pivotally connected to the first rear stand leg 1391 and second ends pivotally connected to the second rear stand leg 1392. For example, when the foldable chair 1390 is in an unfolded configuration (UF) suitable for accommodating the user in a seated position, the third rear stand legs 1393 may form an X-shaped structure.

For example, the first side stand legs 1394 may have first ends pivotally connected to joints with the first rear stand leg 1391, and second ends pivotally connected to joints with the front stand legs 1396. The first side stand legs 1394 may be connected to each other at a center pivot point, and may form an X-shaped structure when the foldable chair 1390 is in the unfolded configuration (UF).

For example, the second side stand legs 1395 may have first ends pivotally connected to joints with the second rear stand leg 1392, and second ends pivotally connected to joints with the front stand legs 1396. The second side stand legs 1395 may be connected to each other at a center pivot point, and may form an X-shaped structure when the foldable chair 1390 is in the unfolded configuration (UF).

Further referring to FIG. 13, a user may grab the second rear stand leg 1392 (or another stand leg 1393, 1394, or 1395 of the foldable chair 1390) to unfold the foldable chair 1390 from a folded configuration (FD) to the unfolded configuration (UF) and to fold the foldable chair 1390 from the unfolded configuration (UF) to the folded configuration (FD). It is to be understood that other foldable chair configurations may be substituted for the configuration of the foldable chair 1390 in other embodiments. For example, the foldable chair 1390 is shown including a seat 1397, armrests 1398, and a backrest 1399. However, the foldable chair 1390 may be provided without the armrests 1398. In another example, the seat 1397 and/or the backrest 1399 may be ventilated. In still another example, the foldable chair 1390 may be provided without the backrest 1399. It is also to be understood that the first pin member 1310 and the second pin member 1320 may be provided in different areas of the foldable chair compartment 1300, for example, in the upper and lower areas 1315 and 1325, where the corresponding sections of the first rear stand leg 1391 are coupled to the first pin member 1310 and the second pin member 1320. It is further to be understood that other coupling means may be utilized to rotatably connect the foldable chair 1390 with respect to the foldable chair compartment 1300 in other embodiments. For example, instead of the first pin member 1310 and the second pin member 1320, one or more hinges may be used. As another example, rotatable coupling joints or swivel joints may be used. Referring to FIGS. 12 and 13, the bag 1000 may further include hook-and-loop (e.g., velcro) fastening members 1350 and 1351 that may be fastened together to prevent the foldable chair 1390, once folded, from unfolding inside the foldable chair compartment 1300. The hook-and-loop fastening member 1351 may be attached to the second rear stand leg 1392 or the foldable chair compartment 1300, or other locations in other embodiments, and may be wrapped over one or more of the stand legs 1391 to 1396 and attached to the hook-and-loop fastening member 1350 to secure the foldable chair 1390 in the folded configuration (FD).

Figure 14:
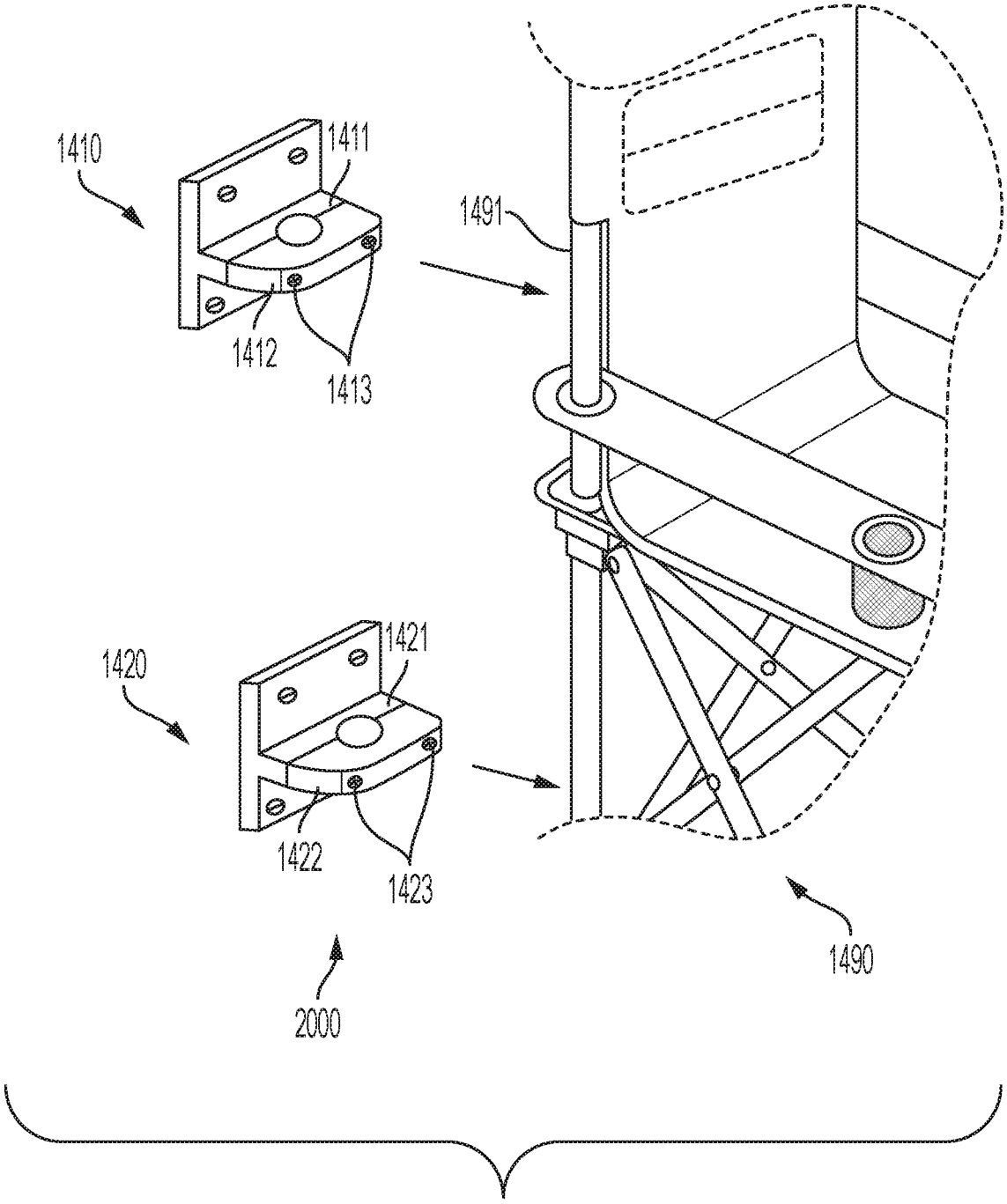
FIG. 14 is a diagram illustrating of first and second pin members and a foldable chair of a bag, according to another embodiment.

FIG. 14 is a diagram illustrating a first pin member 1410, a second pin member 1420, and a foldable chair 1490 (partially shown in FIG. 14) of a bag 2000 (entirety not shown), according to an embodiment. For example, the first pin member 1410, the second pin member 1420, and the foldable chair 1490 may be provided in the bag 1000 of FIGS. 11 to 13, instead of the first pin member 1310, the second pin member 1320, and the foldable chair 1390, respectively. For example, the first pin member 1410 and a second pin member 1420 may detachably receive a first rear stand leg 1491 of the foldable chair 1490. That is, the foldable chair 1490 may be detachably coupled to the bag.

As shown in FIG. 14, the first pin member 1410 may be a two-piece member including a first base member 1411 that is attached to a foldable chair compartment (e.g., an inner side surface of the foldable chair compartment) of the bag, and a first detachable member 1412 attachable to the first base member 1411 by first screws 1413 to secure the first rear stand leg 1491 between the first base member 1411 and the first detachable member 1412. The second pin member 1420 may be a two-piece member including a second base member 1421 that is attached to the foldable chair compartment (e.g., an inner side surface of the foldable chair compartment) of the bag, and a second detachable member 1422 attachable to the second base member 1421 by second screws 1423 to secure the first rear stand leg 1491 between the second base member 1411 and the second detachable member 1412. In this example, the foldable chair 1490 may be rotatably secured to the bag by removing the screws 1413 and 1423, removing the first detachable member 1412 and the second detachable member 1422, inserting the first rear stand leg 1491 into the first base member 1411 and the second base member 1421, aligning the first detachable member 1412 and the second detachable member 1422 on the first base member 1411 and the second base member 1421, respectively, and securing the first screws 1413 and the second screws 1423 into their original locations in the first and second pin members 1410 and 1420, respectively.

It is to be understood that other mounting members including detachable/removable interfaces or mechanisms may be substituted for the first and second pin members 1310/1410 and 1410/1420 with respect to the foldable chair 1390/1490 in other embodiments. For example, a hinge having a pin and a knuckle may be provided, wherein a first leaf part of the knuckle is attached to the foldable chair compartment of the bag and a second leaf part of the knuckle is configured to receive the first rear stand leg 1391/1491. The second leaf part may include a quick release mechanism, for example, a quick release pin, to detachably couple the first rear stand leg 1491 of the foldable chair 1490 to the bag.

Figure 15A:
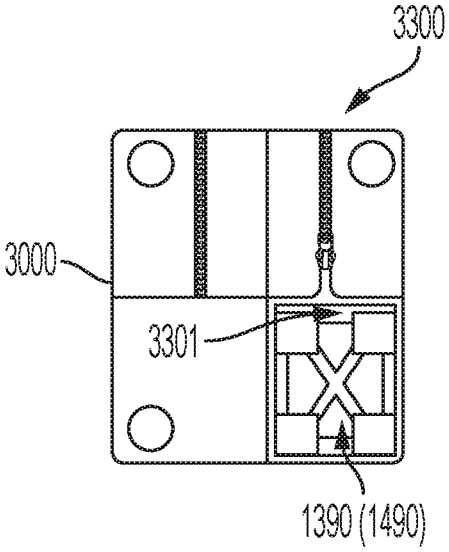
FIGS. 15A and 15B are bottom-view diagrams illustrating bags including a foldable chair compartments, according to other embodiments.
Figure 15B:
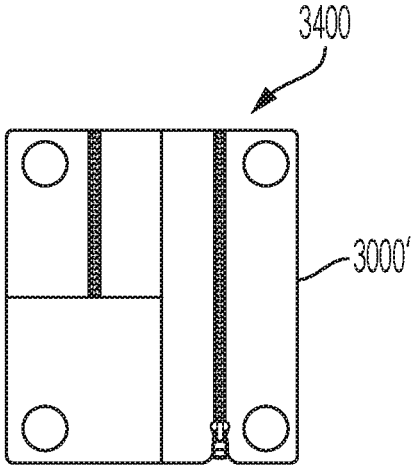

FIGS. 15A and 15B are bottom-view diagrams illustrating an example of bags 3000 and 3000' including foldable chair compartments 3300 and 3400, respectively, according to other embodiments. Referring to FIGS. 15A and 15B, and FIGS. 11 to 14, the bags 3000 and 3000' may be the same as the bag 1000, but the foldable chair compartments 3300 and 3400 may be provided as shown in FIG. 15A or 15B. That is, FIG. 15A shows a bottom of the bag 3000 where the foldable chair compartment 3300, in its closed configuration, includes an opening 3301 through which the feet of the foldable chair 1390 or 1490 are exposed. FIG. 15B shows the bottom of the bag 3000' where the foldable chair compartment 3400, in its closed configuration, houses the foldable chair 1390 or 1490 in a concealed state in which the feet of the foldable chair 1390 or 1490 are covered by the foldable chair compartment 3400. A bag according to another embodiment, may be configured such that a foldable chair may be stored substantially within an interior space of a foldable chair compartment in a folded configuration. However, it is understood that a bag according still another embodiment, may be provided such that an additional portion of a foldable chair may be visible in a folded configuration. For example, where a length of the foldable chair is longer than a length of a foldable chair compartment, far more than the feet of the foldable chair may be visible. As another example, a length of a foldable chair compartment may be equal to or less than a length of a main compartment.

Figure 16:
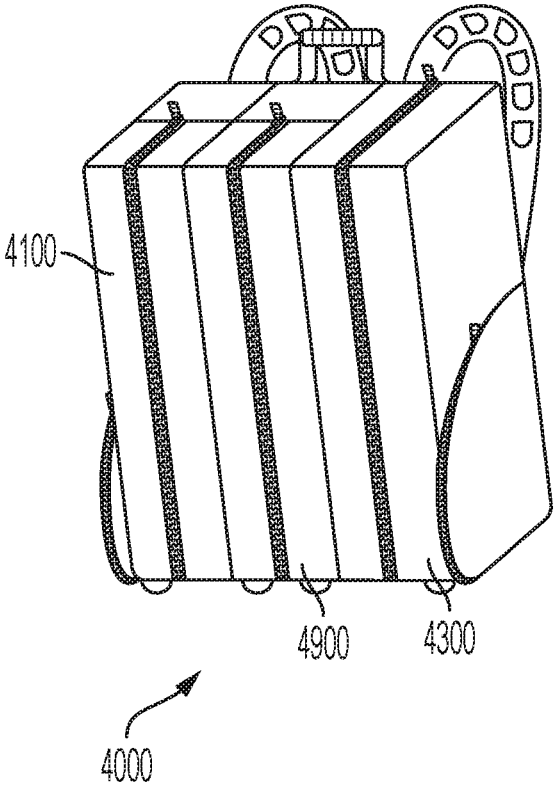
FIG. 16 is a diagram illustrating an example of a bag including a foldable chair compartment, according to another embodiment.

FIG. 16 is a diagram illustrating an example of a bag 4000 including a foldable chair compartment 4300, according to another embodiment. Referring to FIG. 16, compared to the bag 1000 (FIGS. 11 to 14), 3000 (FIG. 15A), or 3000' (FIG. 15B), the bag 4000 further includes a second main compartment 4900 that is disposed between a first main compartment 4100 and the foldable chair compartment 4300. It is to be understood that further description of the embodiment of FIG. 16 is omitted for brevity and conciseness.

Figure 17:
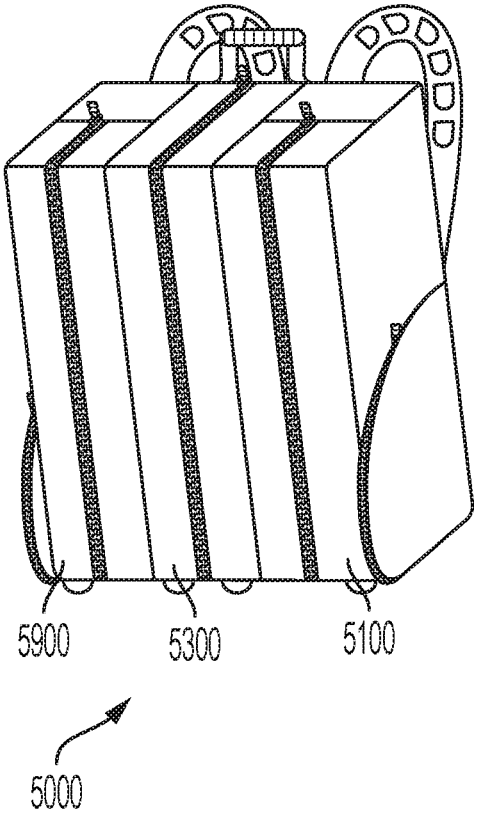
FIG. 17 is a diagram illustrating a bag including a foldable chair compartment, according to another embodiment.

FIG. 17 is a diagram illustrating an example of a bag 5000 including a foldable chair compartment 5300, according to another embodiment. Referring to FIG. 17, compared to the bag 1000 (FIGS. 11 to 14), 3000 (FIG. 15A), or 3000' (FIG. 15B), the bag 5000 further includes a second main compartment 5900, and the foldable chair compartment 5300 is disposed between a first main compartment 5100 and the second main compartment 5900. It is to be understood that further description of the embodiment of FIG. 17 is omitted for brevity and conciseness.

Figure 18A:
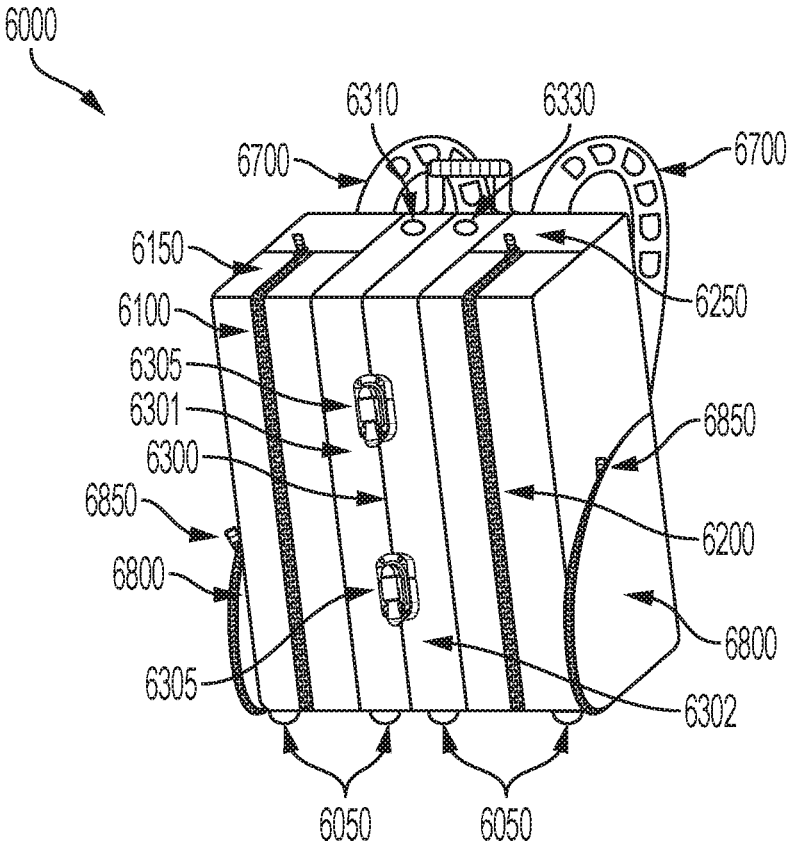
FIGS. 18A and 18B are diagrams illustrating a bag including a foldable chair compartment, according to another embodiment.
Figure 18B:
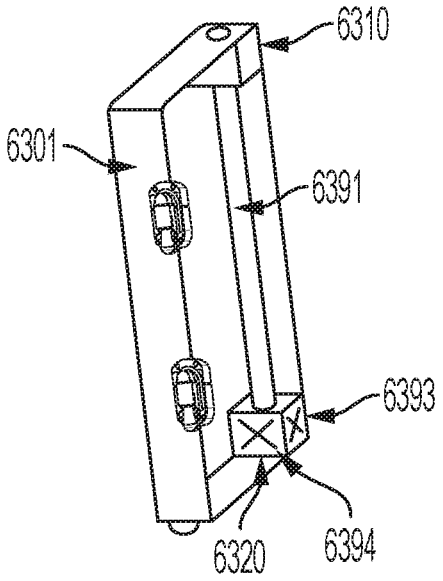

FIGS. 18A and 18B are diagrams illustrating a bag 6000 including a foldable chair compartment 6300, according to another embodiment. Referring to FIGS. 18A and 18B, the bag 6000 may include, for example, a first main compartment 6100, a second main compartment 6200, the foldable chair compartment 6300, and a foldable chair (partially shown by element 6391 described with FIG. 18B below). The bag 6000 may further include shoulder straps 6700, accessory compartments 6800, zippers 6850 operable to provide access to the accessory compartments 6800, zippers 6150 and 6250 operable to provide access to the first and second main compartments 6100 and 6200, respectively, and bag legs 6050. The bag legs 6050 may be disposed at the front of the bag 6000 and the rear of the bag 6000 (not shown in FIG. 18A). The bag 6000 may further include one or more grab-handles (not shown). The bag 6000 may include a greater or fewer number of accessory compartments 6800 and corresponding zippers 6850 than the number of accessory compartments 6800 and corresponding zippers 6850 shown in FIG. 18A.

FIG. 18A shows the bag 6000 with the foldable chair compartment 6300 in a closed position. The foldable chair compartment 6300 may include a first shell 6301, a second shell 6302, and latches 6305 securing the first shell 6301 and the second shell 6302 together. For example, the latches may be provided in front of the bag 6000 as shown in FIG. 18A and in the rear of the bag 6000 (not shown). The latches 6305 may be, for example, toggle latches, draw latches, spring loaded toggle latches, spring loaded draw latches, or handle latches configured to open and close the first shell 6301 and the second shell 6302 with respect to each other to reveal and conceal the foldable chair provided therein. It is to be understood that other mechanisms may be substituted for the latches 6305, in other embodiments. For example, one or more hook-and-loop (e.g., velcro) members may be used instead of the latches 6305.

In response to a user opening the latches 6305 and pulling the first shell 6301 and the second shell 6302 apart from each other, the foldable chair unfolds and reveals itself (not shown). Referring to FIGS. 18A and 18B, the first shell 6301 may include a first pin member 6310 and a second pin member 6320, and a first rear stand leg 6391 of the foldable chair may be pivotally connected to the first pin member 6310 and the second pin member 6320. Similarly, the second shell 6302 may include a third pin member 6330 and a fourth pin member (not shown) configured to receive a second rear stand leg (e.g., the second rear stand leg 1392 of FIGS. 12 and 13 (not shown in FIG. 18B)). Referring to FIG. 18B again, the second pin member 6320 may be provided at positions 6393 and 6394 to receive a third rear stand leg (not shown) and a first side stand leg (not shown) of the foldable chair (refer to the third rear stand leg 1393 and the first side stand leg 1394 of FIG. 12), such that the third rear stand leg and the first side stand leg rotate with respect to the second pin member 6320 at 6393 and 6394 to allow the foldable chair to fold and unfold. Foldable chairs or folding chairs and their folding mechanisms are well known, including rotating of the multiple stand legs to fold and unfold. Thus, further description of folding chairs and folding mechanisms is omitted for brevity and conciseness.

According to an embodiment, the bag 6000 may be a tennis bag and the first and second main compartments 6100 and 6200 may each be sized and configured to store one or more tennis rackets. According to another embodiment, the first and second main compartments 6100 and 6200 may be constructed of a material softer than a material of the foldable chair compartment 6300. For example, the first and second main compartments 6100 and 6200 may be constructed of a material such as nylon and polyester with or without thermoplastic polyurethane coating. For example, the foldable chair compartment 6300 may be constructed of a material harder than the material of the first and second main compartments 6100 and 6200, for example, materials such as polycarbonate, acrylonitrile butadiene styrene, and polypropylene. As can be appreciated, the foldable chair may be quickly stored in or retrieved from the bag 6000, by being housed by the foldable chair compartment 6300. When a user the bag 6000 opens and pulls apart the first shell 6301 and the second shell 6302, the foldable chair may unfold from the foldable chair compartment 6300 to allow the user to sit.

Although the description herein makes numerous references to a "tennis bag," it is to be understood that a bag as described herein may also refer to a bag for other racket sports, such as, but not limited to, racquetball and squash. Additionally, a bag as described herein may also refer to a bag for golf clubs, baseball bats, or fishing rods, for example. Thus, a main compartment of a bag disclosed herein may also be sized and configured to accommodate various rackets, such as, but not limited, to racquetball racket or a squash racket, or to accommodate one or more golf clubs, baseball bats, or fishing rods.

Additionally, examples described herein include zippers, hook-and-loop fastening members, and/or latches operable to provide access to various corresponding compartments.

However, it is to be understood that other closure members may be used in place of the zippers, hook-and-loop fastening members, and latches.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, or device are combined in a different manner, and/or replaced or supplemented by other components or their equivalents. For example, various foldable chair compartments in accordance with various embodiments described above may be applicable to various bags, including but not limited to, tennis bags, sports bags, rucksacks, and carry-on bags. For examples, the bags described above according to the disclosed embodiments may further include one or more roller wheels. Also, the bags may further include a retractable handle. In addition, respective embodiments may be combined with each other.

What is claimed is:

1. A bag comprising:

a main compartment;

a foldable chair compartment disposed adjacent and parallel to the main compartment and sharing an interior wall with the main compartment; and a foldable chair coupled to the foldable chair compartment, wherein the foldable chair is configured to be stored in the interior space when folded, and wherein the foldable chair is configured to expand in two directions when unfolding and retracts in the directions when folding, wherein the directions are perpendicular to each other, wherein the foldable chair is, while coupled with the bag, rotatable with respect to the bag about an axis of rotation that is perpendicular to the ground while the bag is upright.

2. The bag of claim 1, wherein the foldable chair comprises an armrest.

3. A bag comprising:

a chair that is collapsible and is attached to the bag when collapsed and when not collapsed, wherein the chair comprises three feet, and wherein the chair is configured such that, when the chair is collapsed each foot is closer to each of the other feet than when the chair is not collapsed;

a chair compartment comprising an opening, the chair compartment configured to enclose the chair when the chair is collapsed, wherein the bag is configured such that only one of the three feet is attached to the bag when the chair is not collapsed; and a storage compartment.

4. The bag of claim 3, further comprising shoulder straps aligned with a vertical leg of the chair when the foldable chair is collapsed and when the chair is not collapsed.

5. The bag of claim 3, wherein the chair is configured such that, when the chair is uncollapsing, at least two of the feet both move away from each other and both move away from the bag.

6. The bag of claim 3, wherein the chair is columnar shaped when collapsed.

7. The bag of claim 6, wherein the columnar shape, the chair compartment, and the storage compartment are each parallel with respect to each of the others.

8. The bag of claim 3, wherein the chair comprises armrests configured to deploy when the chair is not collapsed.

9. The bag of claim 3, wherein the chair comprises two back legs that are each parallel to each other when the chair is collapsed and when the chair is not collapsed.

10. The bag of claim 3, further comprising a second main compartment, wherein the chair compartment is between the storage compartment and the second main compartment.

11. The bag of claim 3, wherein the bag is a tennis bag.

12. The bag of claim 11, wherein the storage compartment is at least partially shaped in correspondence with a tennis racquet shape and is configured to store a tennis racquet.

13. The bag of claim 3, wherein the storage compartment having a shape configured to store tennis racquets.

14. The bag of claim 13, wherein the bag further comprises a second storage compartment having a shape configured to store tennis racquets.

15. A bag comprising:

a chair that is collapsible and is attached to the bag when collapsed and when not collapsed, wherein the chair comprises three feet, and wherein the chair is configured such that, when the chair is collapsed each foot is closer to each of the other feet than when the chair is not collapsed;

a chair compartment comprising an opening, the chair compartment configured to enclose the chair when the chair is collapsed, wherein the bag comprises shoulder straps, and wherein the bag is configured to allow the chair to rotate into and out of the chair compartment about an axis of rotation that is aligned with the shoulder straps.

16. A bag comprising:

a chair that is collapsible and is attached to the bag when collapsed and when not collapsed, wherein the chair comprises three feet, and wherein the chair is configured such that, when the chair is collapsed each foot is closer to each of the other feet than when the chair is not collapsed;

a chair compartment comprising an opening, the chair compartment configured to enclose the chair when the chair is collapsed, wherein the bag comprises a backpack, and wherein the bag is configured to allow the chair to rotate into and out of the chair compartment about an axis of rotation that is upright when the bag is upright.

17. The bag of claim 16, further including a storage compartment, wherein the storage compartment and the chair compartment share an interior wall.

18. A bag comprising:

a chair that is collapsible and is attached to the bag when collapsed and when not collapsed, wherein the chair comprises three feet, and wherein the chair is configured such that, when the chair is collapsed each foot is closer to each of the other feet than when the chair is not collapsed;

a chair compartment comprising an opening, the chair compartment configured to enclose the chair when the chair is collapsed, wherein a first leg of the back legs is hingedly mounted to the bag, wherein a second leg of the back legs is not hingedly mounted to the bag, and wherein, when the bag is upright, the back legs are both perpendicular to the ground when the chair is collapsed and when the chair is not collapsed.

19. The bag of claim 18, wherein the chair further comprises a seat and a back strung between two respective portions of the two back legs, and wherein the portions of the back legs are closer to each other when the chair is collapsed than when the chair is not collapsed.

20. A bag comprising:

a chair that is collapsible and is attached to the bag when collapsed and when not collapsed, wherein the chair comprises three feet, and wherein the chair is configured such that, when the chair is collapsed each foot is closer to each of the other feet than when the chair is not collapsed;

a chair compartment comprising an opening, the chair compartment configured to enclose the chair when the chair is collapsed, wherein the bag has a length and a width, wherein the length is greater than the width, and wherein the bag is configured to allow the chair to rotate about an axis aligned with the length of the bag.

21. A backpack comprising:

shoulder straps;

a main compartment;

a chair compartment;

a chair movably attached to the backpack, the chair comprising three feet, wherein the feet define the corners of a triangle having three sides, wherein the chair is configured to be collapsible such that when the chair is collapsing each side of the triangle decreases in length and when the chair is uncollapsing each side of the triangle increases in length, wherein the chair comprises a back leg hingedly mounted to the backpack, wherein when the backpack is vertical and resting on the ground: the back leg is vertical both when the chair is collapsed and when the chair is not collapsed, and when the chair is not collapsed the feet rest on the ground.

22. The backpack of claim 21, wherein the chair compartment is closeable and is configured to enclose the chair when the chair is collapsed and when the chair compartment is closed.

23. The backpack of claim 22, wherein the chair compartment comprises an opening at the top or the bottom thereof.

24. The backpack of claim 21, wherein when the main compartment and the chair compartment are closed, the main compartment encompasses a volume as large as, or larger than, the chair compartment.

* * * * *